US006211845B1

(12) United States Patent
Cook et al.

(10) Patent No.: US 6,211,845 B1
(45) Date of Patent: Apr. 3, 2001

(54) BRACKET MOUNT FOR PRECISE ANTENNA ADJUSTMENT

(75) Inventors: Charles William Cook, Palo Alto, CA (US); Jason A. Kay, Morristown; David Stevens Kerr, Morris Plains, both of NJ (US); Ivan Pawlenko, Holland, PA (US); Richard Franklin Schwartz, Cranbury, NJ (US)

(73) Assignee: Avaya Technology Corp., Miami Lakes, FL (US)

( * ) Notice: Subject to any disclaimer, the term of this patent is extended or adjusted under 35 U.S.C. 154(b) by 0 days.

(21) Appl. No.: 09/407,070

(22) Filed: Sep. 28, 1999

(51) Int. Cl.[7] ..... H01Q 3/02
(52) U.S. Cl. ..... 343/882; 343/840
(58) Field of Search ..... 343/765, 882, 343/880, 840

(56) References Cited

U.S. PATENT DOCUMENTS

| | | | | |
|---|---|---|---|---|
| 5,526,010 | * | 6/1996 | Plunk | 343/882 |
| 5,670,967 | * | 9/1997 | Sarjala | 343/882 |
| 5,877,730 | * | 3/1999 | Foster | 343/840 |
| 5,886,673 | * | 3/1999 | Thomas | 343/882 |

* cited by examiner

*Primary Examiner*—Tan Ho
*Assistant Examiner*—Wilson Lee

(57) ABSTRACT

A bracket mount for precise antenna adjustment includes a lever or mechanical assist to permit slight movements to the antenna simply by manipulating the lever. The adjustable lever may be a built-in cam or yoke, or may be removably attached to the mount and antenna by an anchoring screw which acts to secure the antenna in place once the desired direction is achieved. The bracket mount may further include two adjusting levers, one for adjusting antenna direction in an up/down direction, and the other for adjusting the antenna in a left/right direction.

33 Claims, 3 Drawing Sheets

BRACKET MOUNT FOR PRECISE ANTENNA ADJUSTMENT

BACKGROUND OF THE INVENTION

1. Field of the Invention

The present invention relates to a mount for antennas, more particularly to an adjustable bracket mount.

2. Description of the Related Art

Antennas used for digital satellite broadcast (DBS), wireless and TV systems are typically mounted to a structure or planar surface (such as a roof or chimney of a house) by a mounting bracket. To fasten or loosen the antenna to the structure, a single bolt or screw is normally employed. However, positioning the antenna's direction to obtain desired reception can be a cumbersome task for the owner or user.

For instance, when installing an antenna dish for television reception (a DIRECT TV® dish, for example), the owner typically climbs a ladder to his roof or chimney to adjust the antenna by hand. He must first loosen the securing screw, and then manipulate the antenna with his hand in a very small space, while receiving commands from another person who is viewing the television screen to see if the antenna is oriented so as to obtain optimal reception. This can be quite difficult (and dangerous) since the user must balance himself on the ladder while often using both hands to adjust the antenna.

This problem is compounded when mounting or adjusting an antenna at the top of a 100-foot tower, in order to provide wireless communications services to a wide area of subscribers. A technician must scale the tower, manipulate the antenna to achieve the desired positioning, and then secure the antenna in place by hand. Therefore, there is a need for a device which makes it easier to manipulate an antenna in a small space so as to obtain the desired reception.

SUMMARY OF THE INVENTION

The present invention includes a novel bracket mount including an adjustable bracket for precise antenna adjustment. The bracket includes a lever or mechanical assist to make slight movements to the antenna simply by manipulating the lever with one hand. The adjustable lever can be a built-in cam or yoke, or may be removably attached to the antenna by an anchoring screw which acts to secure the antenna in place once the desired antenna direction is achieved. The bracket mount more preferably includes two adjusting levers, one for adjusting antenna direction in an up/down direction, the other for adjusting the antenna in a left/right direction.

BRIEF DESCRIPTION OF THE DRAWINGS

The present invention will become more fully understood from the detailed description given hereinbelow and the accompanying drawings, wherein like elements are represented by like reference numerals, which are given by way of illustration only and thus are not limitative of the present invention and wherein.

DETAILED DESCRIPTION OF THE PREFERRED EMBODIMENT

The preferred embodiment of the present invention provides a bracket mount including a bracket having an adjustable lever, enabling a user to make slight movements to the antenna simply by manipulating the lever with his hand. This mechanical advantage makes for easier and smoother movement of a heavy antenna to allow for more precise alignment of the antenna, thereby obtaining optimal signal strength for antenna operations. Additionally, easier alignment enables cheaper installation and maintenance of the antenna, and allows customers or users to adjust the antenna on their own, thereby preventing costly service visits from installers.

Figure 1:
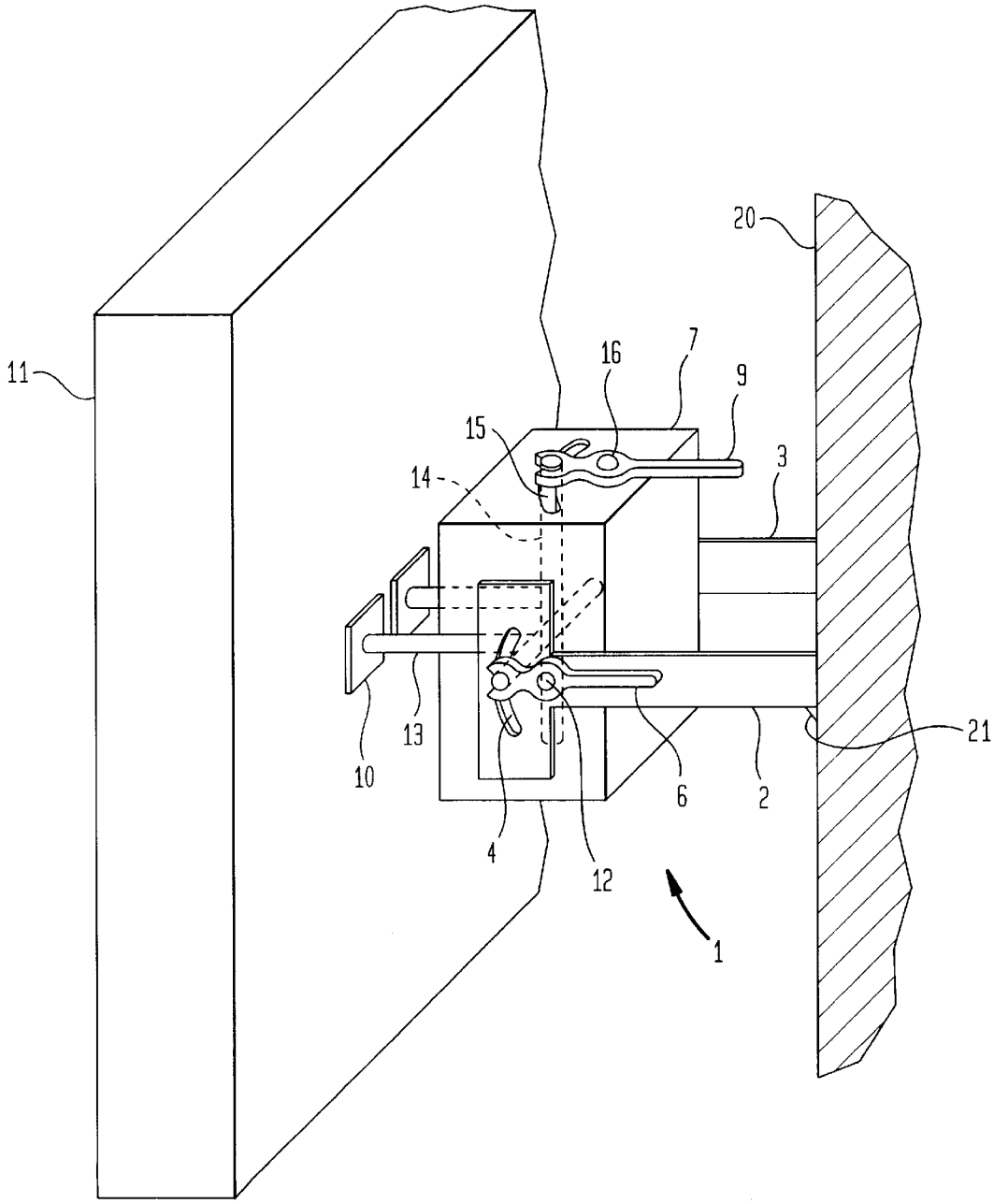
FIG. 1 is a side view of a bracket mount in accordance with the preferred embodiment of the present invention.
Figure 2:
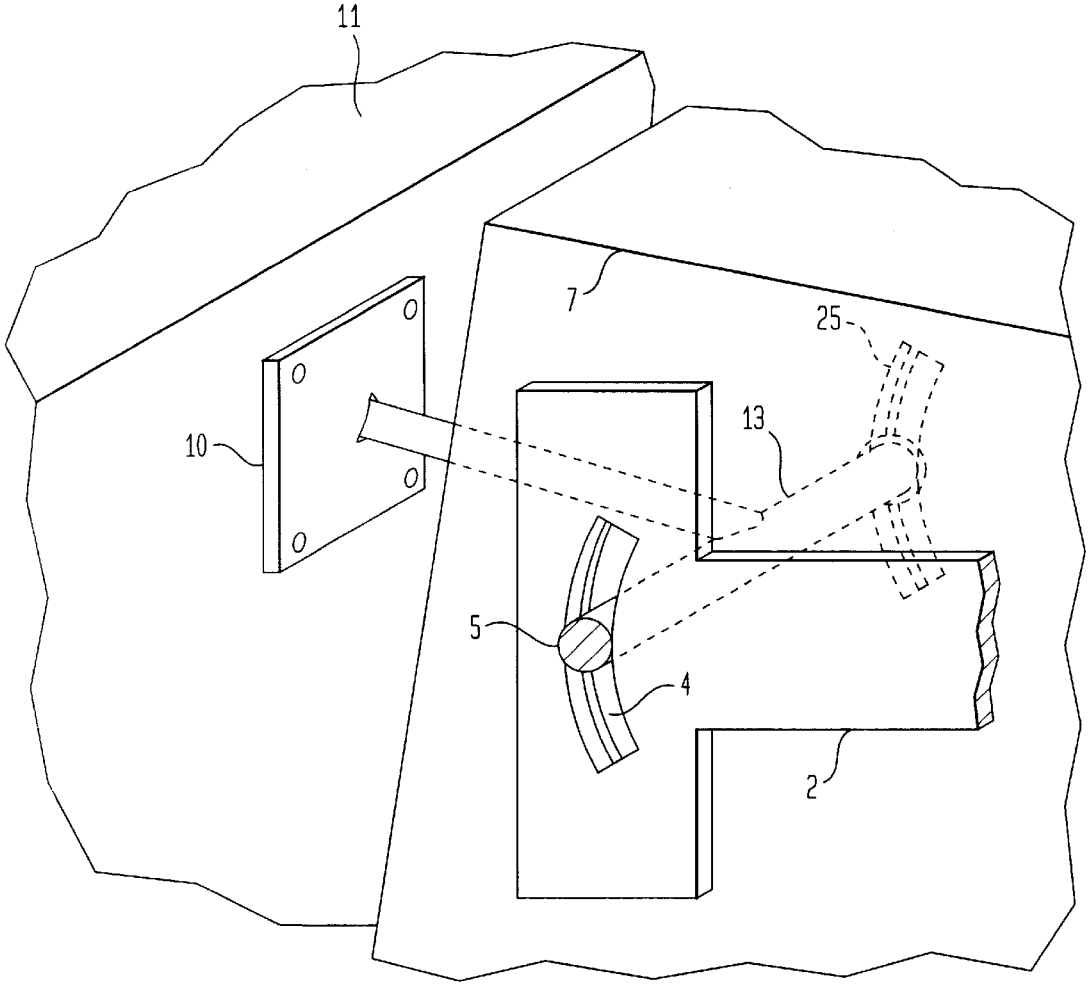
FIG. 2 is a partial view of the cross piece and slot in accordance with the preferred embodiment of the present invention.

FIG. 1 illustrates a side view of the preferred embodiment of the present invention; and FIG. 2 depicts a partial view of FIG. 1 of the preferred embodiment. Referring to FIGS. 1 and 2, the preferred embodiment comprises a bracket mount 1 which is attached to an antenna 11 by a support plate 10. Each of the components in bracket mount 1 are fabricated from a weatherable material, preferably a material from a group including, but not limited to: stainless steel, rust resistant alloys, painted or plastic-coated metals, and/or UV-stable plastics. The bracket mount 1 may be secured to antenna 11 by other securing means, such as by welding, with rivets, screws, etc. Antenna 11 may be an antenna which is employed in television, fixed wireless, wireless cable and wireless internet (i.e., cable TV or internet service delivered via airwaves, much like fixed wireless is to telephony), and/or direct broadcast satellite systems, for example.

The bracket mount 1 preferably includes a box enclosure 7 which is attached to the rear of the antenna 11 by arms of T-shaped cross pieces 13 and 14 extending through box enclosure 7. Further, a pair of bracket arms 2 and 3 attached at sides of box enclosure 7 secure box enclosure 7 (and antenna 11) to a fixed medium 20 (such as a wall, roof or chimney). Although bracket arms 2 and 3 are shown attached to fixed medium 20 by welds 21, other securing means such as rivets, heavy duty masonry bolts, etc. may be employed. Alternatively, a single bracket may be employed which is connected in the center of one side of the box enclosure 7 to connect antenna 11 with fixed medium 20. Further, box enclosure 7 may be directly affixed to fixed medium 20 to support antenna 11 via cross pieces 13 and 14.

In at least one of the brackets (here shown in bracket 2) there is a slot 4 through which cross piece 13 protrudes, Slot 4 also extends through box enclosure 7 (i.e., there is a corresponding slot formed on the side of box enclosure 7 which mates with bracket arm 2). The slot is preferably C-shaped to permit longitudinal travel of the cross piece 13 therein; however, any shape which promotes a translational motion therein is acceptable. For example, a slot having a plurality of graduated stops may be employed, so that after cross piece 13 has been adjusted (to be discussed hereinafter), it is securedly fixed between stops due to friction between the stops and cross piece 13 within the slot 4. Cross piece 13 extends within box enclosure 7 and is movable therein, with one end moveably attached within box enclosure 7 in a corresponding slot 25, and the other protruding through slot 4 and bracket 2. Slot 25 is a recessed groove within box enclosure 7. Alternatively, slot 25 may be formed in bracket 25 and on the side of box enclosure 7 that bracket arm 3 so that cross piece 13 extends therethrough. Further, cross piece 13 is preferably T-shaped such that it connected to antenna 11 at support plate 10, as illustrated in FIGS. 1 and 2. However, any shape or mechanism which translates motion in an up-down direction to antenna 11 (for example, a series of gears) is acceptable for cross piece 13.

Attached to cross piece 13 is a first lever 6. Lever 6 may be a built-in cam or yoke which is held in place by friction created between lever 6 contacting cross piece 13 and bracket arm 2. Alternatively, lever 6 may be removably connected to the cross piece 13 and bracket arm 2 by an anchoring screw 5. This anchoring screw 5 can be used in any environment, and is particularly applicable in sea coast environments or in area of high wind conditions. Anchoring screw 5 acts as a securing mechanism to secure the antenna 11 after it is positioned appropriately by using lever 6. Lever 6 is preferably fabricated from a material having similar properties (for example, a weatherable material) to the other components in the bracket mount 1.

In operation, lever 6 rotates around a pivot 12 which is secured to box enclosure 7 through a hole (not shown) in bracket arm 2. Alternatively, pivot 12 may be a protrusion molded into bracket arm 2 about which lever 6 rotates. The pivot 12 is provided to shorten the moment arm of the lever 6, as compared to the case where no pivot is employed (i.e., without pivot 12 lever 6 would act like a wrench). Lever 6 rotates about pivot 12 to translate motion to cross piece 13, the operation of which is discussed below. Further, lever 6 is preferably shaped such that it is easily grasped and manipulated by the human hand, as shown in FIGS. 1 and 2. Additionally in the preferred embodiment, there is a second lever 9 which is connected to a T-shaped cross piece 14 protruding through the top of box enclosure 7. Similar to the first lever 6, second lever 9 rotates about a pivot 16 to move cross piece 14 within a second C-shaped slot 15. The operation of lever 9 and cross piece 14 will be discussed hereinafter below.

FIG. 2 is a partial view of FIG. 1 and illustrates the operation of the first lever 6 and cross piece 13 in accordance with the preferred embodiment. To adjust the antenna in an up and down direction, the user manipulates lever 6 with his hand to translate motion to cross piece 13. In the case where an anchoring screw 5 is employed, the user first loosens anchoring screw 5 to enable lever 6 to be adjusted. Cross piece 13 moves within slot 4 and a corresponding slot 25, and although these slots illustrate a wide margin of travel, in practice only slight movements of the antenna are necessary to achieve the desired reception. As shown in FIG. 2, slot 25 is preferably a recess in the opposite side of box enclosure 7. As cross piece 13 moves up or down within slots 4 and 25 due to the motion imparted by lever 6, it translates its motion so as to adjust antenna 11 according to the desired movement imparted by the user manipulating lever 6. Thus, precise up and down movements of the antenna 11 can be achieved simply by adjusting lever 6 by hand. There is sufficient friction at the interface between cross piece 13 and the inner sides of slots 4 and 25 so that the cross-piece maintains its position within slots 4 and 25 upon being manipulated via lever 6 (i.e., antenna orientation is held, the cross-piece does not freely move within slots 4 and 25 due to friction between mating metal or plastic surfaces). Once desired antenna position is obtained, anchoring screw 5 is finally tightened to secure the antenna 11 in place.

Figure 3:
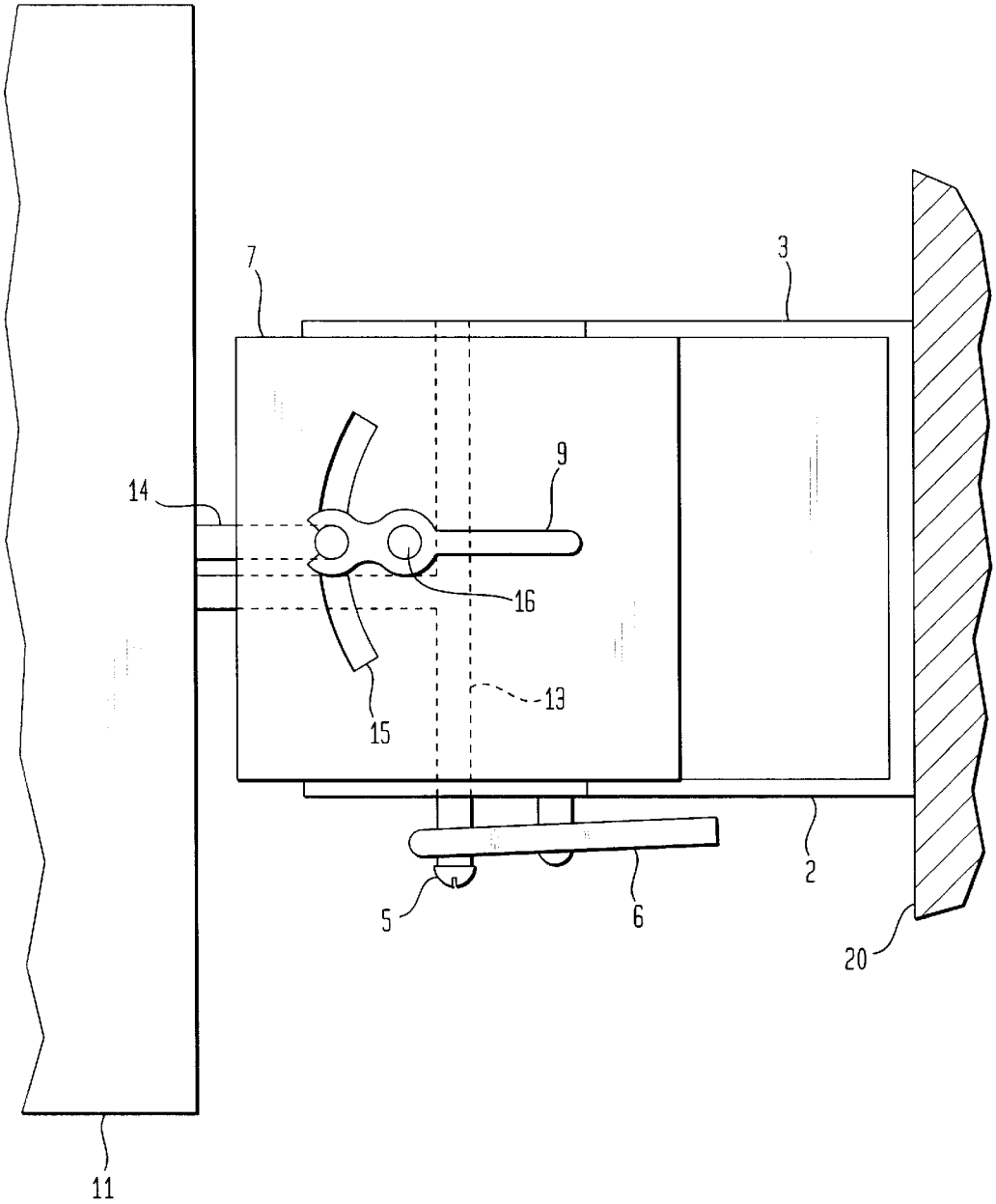
FIG. 3 is a top view of the bracket mount in accordance with the preferred embodiment of the present invention.

FIG. 3 is a top view of the preferred embodiment and illustrates the structure of the second lever 9, which is manipulated for left to right movement of antenna 11. As discussed above with respect to the first lever 6, second lever 9 is preferably a cam or yoke which is built in (i.e. secured by friction). Alternatively, lever 9 is removably connected to cross piece 14 by way of an anchoring screw similar to that shown in FIGS. 1 and 2, the anchoring screw being loosened to allow lever 9 to be manipulated by the user, an then tightened once desired antenna position is achieved. Cross piece 14 is similarly T-shaped like cross piece 13, and is connected to antenna 11 by the middle of the "T".

To adjust antenna 11 left and right, a user manipulates lever 9 via a pivot 16 to translate motion cross piece 14. Cross piece 14 moves in a slot 15 and a corresponding recessed slot (not shown for clarity) in the opposite side of box enclosure 7. As shown in FIG. 3, cross pieces 13 and 14 are slightly offset to prevent one movement (i.e. left-right) from interfering with another movement (i.e. up-down). As discussed above, actual travel within slot 15 is slight, thus only a slight offset between the cross pieces is necessary. Therefore, translational motion imparted to cross piece 14 from lever 9 enables antenna 11 to rotate about an axis in a left or right direction so as to achieve desired antenna reception.

Accordingly, the bracket mount 1 of the present invention provides a mechanical advantage in the form of a series of removable levers 6 and 9 which enable a user or operator to easily manipulate a large or heavy object such as an antenna 11 in small spaces simply by adjusting levers 6 and/or 9. Further, the lever 6 (and lever 9) is secured with an anchoring screw 5 which, besides securing the levers to the bracket mount 1, anchors antenna 11 in place once the desired position is obtained.

Therefore, the bracket mount 1 of the present invention allows for more precise alignment of the antenna 11 and enables easier and smoother movement of heavy antennas in a smaller space. The ability to smoothly move the antenna 11 for precise alignment means cheaper installation and maintenance costs to install the antenna 11, and also allows the owner or user to adjust the antenna 11 on their own, thereby saving additional costs in the form of service fees to adjust the antenna, as well as obtaining optimal signal strength for antenna operations.

The invention being thus described, it will be obvious that the same may be varied in many ways. For example, the shape of cross pieces 13 and 14 is not limited to a T-shape; any type of structural member which transforms motion from one plane or dimension (i.e., horizontal) to another (i.e., vertical) is acceptable. Additionally, servo-controlled actuators may replace levers 6 and 9 such that antenna movement may be initiated electrically from a remote location. The aforementioned variations are not to be regarded as a departure from the spirit and scope of the invention, and all such modifications as would be obvious to one skilled in the art are intended to be included within the scope of the following claims.

What is claimed is:

1. An adjustable bracket mount for precise positioning of an antenna, comprising:

a pair of brackets attached at one end to a fixed planar surface and at the other end to said antenna;

a slot formed in each of said brackets, thereby providing corresponding slots;

a cross piece connected to said antenna, said cross-piece being movable within said corresponding slots to precisely adjust said antenna; and a removable yoke for adjusting said cross-piece.

2. The adjustable bracket mount of claim 1, further including an anchoring screw to secure said yoke to said cross-piece.

3. The adjustable bracket mount of claim 1, said cross piece being T-shaped with a portion connected to said antenna.

4. The adjustable bracket mount of claim 1, wherein said yoke enables antenna movement in an up and down direction with respect to said planar surface.

5. The adjustable bracket mount of claim 1, wherein said cross piece is located within a hollow box attached to said antenna, said brackets attached to said box on opposite sides thereof.

6. The adjustable bracket mount of claim 1, further including a hollow box enclosing said cross piece and attached to said antenna, and a second adjustable yoke attached to a second cross piece protruding out a top side of said box to connect to said second yoke.

7. The adjustable bracket mount of claim 6, wherein said second yoke enables antenna movement in a left-right direction with respect to said planar surface by moving said second cross piece within a pair of corresponding slots recessed in top and bottom sides of said box.

8. The adjustable bracket mount of claim 1, said corresponding slots being C-shaped.

9. The adjustable bracket mount of claim 1, said corresponding slots having a plurality of graduated stops thereon.

10. The adjustable bracket mount of claim 5, said box attached to said fixed planar surface by a single bracket connected to said box at a center thereon, in lieu of said pair of brackets.

11. The adjustable bracket mount of claim 5, said box directly attached to said fixed planar surface without said pair of brackets.

12. A mechanical assist device for use in adjusting and securing an antenna, comprising:

a hollow box attached to said antenna;

bracket arms attached at sides of said box to connect said antenna and box with a fixed surface;

a lever attached to said box by an anchoring screw, said lever being adjustable in corresponding slots extending through said box and at least one of said bracket arms to provide mechanical leverage for precisely adjusting said antenna in tight spaces while simultaneously anchoring said antenna to said fixed surface.

13. The mechanical assist device of claim 12, wherein said lever enables antenna movement in an up and down direction with respect to said fixed surface.

14. The mechanical assist device of claim 12, further comprising a cross-piece, said cross piece being T-shaped with a portion connected to said antenna.

15. The mechanical assist device of claim 12, further including a rotatable cross piece within said box, said cross-piece oriented perpendicular to a longitudinal direction of each of said bracket arms and supported at one end of said box within one of said corresponding slots, the other end of said cross piece extending through said slot.

16. The mechanical assist device of claim 15, wherein said lever is attached to said cross piece, said lever secured by said anchoring screw.

17. The mechanical assist device of claim 15, further including a second adjustable lever attached to a second cross piece protruding out a top side of said box to connect to said second lever, said second cross piece movable within a pair of corresponding slots formed in top and bottom sides of said box.

18. The mechanical assist device of claim 17, wherein said second lever enables antenna movement in a left-right direction with respect to said fixed surface.

19. The mechanical assist device of claim 12, said corresponding slots being C-shaped.

20. The mechanical assist device of claim 12, said corresponding slots having a plurality of graduated stops thereon.

21. The mechanical assist device of claim 12, said box attached to said fixed surface by a single bracket connected to said box at a center thereon, in lieu of said pair of brackets.

22. The mechanical assist device of claim 12, said box directly attached to said fixed surface without said pair of brackets.

23. The adjustable bracket mount of claim 1, wherein said antenna is used in at least one of a television, fixed wireless, wireless cable, wireless internet and direct broadcast satellite system.

24. The mechanical assist device of claim 12, wherein said antenna is used in at least one of a television, fixed wireless, wireless cable, wireless internet and direct broadcast satellite system.

25. The adjustable bracket mount of claim 1, wherein said removable yoke acts as a mechanical assist, thereby enabling a person to manipulate a heavy antenna for obtaining desired reception.

26. The mechanical assist device of claim 12, said lever enabling a person to manipulate a heavy antenna for precise positioning, thereby preventing costly service visits to adjust said heavy antenna.

27. An adjustable bracket mount for precise positioning of an antenna, comprising:

a pair of rigid bracket arms attached at one end to a fixed planar surface and at the other end to opposite sides of a hollow box which is connected to said antenna, said bracket arms oriented perpendicular to said planar surface and said antenna;

a first pair of corresponding slots formed in at least one of said bracket arms and in said opposite sides of said box;

a first movable cross-piece extending within said slots and oriented perpendicular to a longitudinal direction of each of said arms, one end of said cross-piece attached to said antenna, the other end extending through said slot; and a first yoke removably connected to said cross-piece at one of said corresponding slots for enabling antenna movement in an up and down direction with respect to said planar surface;

a second movable cross-piece extending between a second corresponding pair of slots formed in a top side and a bottom side of said box, one end of said cross piece attached to said antenna, the other end extending through one of said second pair of slots; and a second yoke removably connected to said second cross piece at one of said second pair of corresponding slots for enabling antenna movement in a left and right direction with respect to said planar surface, said first and second yokes providing precise antenna adjustment for optimal signal strength.

28. The adjustable bracket mount of claim 27, each of said cross pieces being T-shaped with a portion connected to said antenna.

29. The adjustable bracket mount of claim 27, wherein said antenna is used in at least one of a television, fixed wireless, wireless cable, wireless internet and direct broadcast satellite system.

30. The adjustable bracket mount of claim 27, each of said slots being C-shaped.

31. The adjustable bracket mount of claim 27, each of said slots having a plurality of graduated stops thereon.

32. The adjustable bracket mount of claim 27, said box attached to said fixed planar surface by a single bracket connected to said box at a center thereon, in lieu of said pair of brackets.

33. The adjustable bracket mount of claim 5, said box directly attached to said fixed planar surface without said pair of brackets.

* * * * *